US011165145B2

(12) United States Patent
Liu et al.

(10) Patent No.: US 11,165,145 B2
(45) Date of Patent: Nov. 2, 2021

(54) BASE STATION ANTENNA

(71) Applicant: CommScope Technologies LLC, Hickory, NC (US)

(72) Inventors: Maosheng Liu, Jiangsu (CN); HanXing Xu, Jiangsu (CN); Rui An, Jiangsu (CN); GuoLong Xu, Jiangsu (CN); ZhaoHui Liu, Jiangsu (CN); Ruixin Su, Jiangsu (CN); PuLiang Tang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 82 days.

(21) Appl. No.: 16/427,898

(22) Filed: May 31, 2019

(65) Prior Publication Data

US 2020/0251815 A1 Aug. 6, 2020

(30) Foreign Application Priority Data

Feb. 2, 2019 (CN) ..... 201920183362.7

(51) Int. Cl.
*H01Q 1/42* (2006.01)
*H01Q 1/12* (2006.01)

(52) U.S. Cl.
CPC ..... *H01Q 1/42* (2013.01); *H01Q 1/12* (2013.01)

(58) Field of Classification Search
None
See application file for complete search history.

(56) References Cited

U.S. PATENT DOCUMENTS 4,128,840 A * 12/1978 Tucker ..... H01Q 9/30 333/224
5,896,112 A * 4/1999 Bickford ..... H01Q 1/42 343/829
7,227,505 B2 * 6/2007 Kim ..... H01Q 1/246 343/766
8,089,420 B2 * 1/2012 Augustin ..... H01Q 1/42 343/872

(Continued)

FOREIGN PATENT DOCUMENTS

CN 202888405 U * 4/2013

*Primary Examiner* — Amy Cohen Johnson
*Assistant Examiner* — James H Cho
(74) *Attorney, Agent, or Firm* — Myers Bigel, P.A.

(57) ABSTRACT

The present disclosure has disclosed a base station antenna comprising an antenna core provided with an antenna base at the bottom thereof and provided with an antenna bracket at the top thereof; and a radome sleeved over the antenna core. The radome includes a top wall and a side wall that protrudes downward from the top wall. The antenna core and the radome are connected together by a fixed connection portion located near a bottom end of the radome and a floating connection portion located near a top end of the radome. The floating connection portion fixes a position of the radome on the antenna core in a horizontal direction and allows the radome to float relative to the antenna core in a vertical direction by cooperating the antenna bracket with the top wall of the radome or the side wall at the top of the radome. The base station antenna solves the problem of a tensile force between the antenna core and the radome resulting from the temperature change, thereby improving the performance parameters such as PIM of the base station antenna.

20 Claims, 7 Drawing Sheets

(56) References Cited

U.S. PATENT DOCUMENTS

| | | | | |
|---|---|---|---|---|
| 9,537,206 | B2 * | 1/2017 | Berger | H01Q 1/42 |
| 10,615,514 | B2 * | 4/2020 | Lee | H01Q 21/205 |
| 2008/0122708 | A1 * | 5/2008 | Lindackers | H01Q 1/1214 343/713 |
| 2013/0285877 | A1 * | 10/2013 | Desclos | H01Q 5/371 343/872 |
| 2014/0125549 | A1 * | 5/2014 | Kaneko | H01Q 1/42 343/872 |
| 2019/0165446 | A1 * | 5/2019 | Matchett | H01Q 1/42 |
| 2019/0229394 | A1 * | 7/2019 | Joseph | H01Q 11/08 |

* cited by examiner

BASE STATION ANTENNA

RELATED APPLICATION

The present application claims priority from and the benefit of Chinese Patent Application No. 201920183362.7, filed Feb. 2, 2019, the disclosure of which is hereby incorporated herein by reference in its entirety.

FIELD OF THE INVENTION

The present disclosure generally relates to the field of communication. More specifically, the present disclosure relates to a base station antenna mounting technique.

BACKGROUND OF THE INVENTION

Various base station antennas are widely used in mobile communication networks to receive and transmit base station signals. Base station antennas are typically installed outdoors and are subject to various challenges from natural environment. A conventional base station antenna has an antenna core and a radome that is sleeved over the antenna core. The radome protects the antenna core from damages of natural environment (such as direct sunlight, rain, snow, ice, etc.).

FIG. 1 shows a cross-sectional view of a base station antenna in the prior art. As shown in the drawing, the antenna core CRE and the radome RDM are connected together by upper and lower connection portions. Specifically, the upper portion of the antenna core CRE and the upper portion of the radome RDM are fixed together along a circumferential direction by a plurality of rivets (see FIG. 2A), and the lower portion of the antenna core CRE and the lower portion of the radome RDM are fixed together along a circumferential direction by a plurality of screws (see FIG. 2B). The antenna core CRE, which is usually made of aluminum alloy, and the radome RDM which is usually made of plastic, typically have significantly different thermal expansion coefficients. When the ambient temperature changes, the antenna core CRE and the radome RDM expand and contract at different rates, such that the radome RDM generates a tensile force on the antenna core CRE at attachment points. Such tensile force may affect the performance parameters (e.g., passive intermodulation (PIM)) of the base station antenna, and even affect normal operation of the base station antenna in severe cases.

SUMMARY OF THE INVENTION

One of the objects of the present disclosure is to provide a base station antenna that overcomes at least one of the defects in the prior art.

The subject art of the present disclosure has been illustrated according to various aspects described below. These clauses are provided as embodiments, rather than limiting the subject art of the present disclosure.

As a first aspect, embodiments of the invention are directed to a base station antenna comprising:

an antenna core provided with an antenna base at the bottom thereof and provided with an antenna bracket at the top thereof; and a radome sleeved over the antenna core, wherein the radome includes a top wall and a side wall that protrudes downward front the top wall.

wherein the antenna core and the radome are connected together by a fixed connection portion located near a bottom end of the radome and a floating connection portion located near a top end of the radome, wherein the floating connection portion fixes a position of the radome on the antenna core in a horizontal direction and allows the radome to float relative to the antenna core in a vertical direction by cooperating the antenna bracket with the top wall of the radome or the side wall at the top of the radome.

In some embodiments, the floating connection portion is configured as a hole and projection engagement between the antenna bracket and the top wall of the radome.

In some embodiments, the antenna bracket is provided with holes, and a lower surface of the top wall of the radome is provided with projections projecting downwardly, wherein the holes and the projections are in corresponding positions along a circumferential direction and a radial direction of the base station antenna.

In some embodiments, the holes are disposed at a radial outer portion of the antenna bracket along a circumferential direction, and the projections are disposed at a radial outer portion of the lower surface of the top wall of the radome along a circumferential direction.

In some embodiments, the projections are formed integrally with the radome.

In some embodiments, the projections are formed separately from the radome and fixed to the radome.

In some embodiments, the projections and the holes are circular, elliptical, or polygonal.

In some embodiments, the antenna bracket is provided with projections projecting upwardly, and the lower surface of the top wall of the radome is provided with blind holes, wherein the blind holes and the projections are in corresponding positions along a circumferential direction and a radial direction of the base station antenna.

In some embodiments, the blind holes are disposed at a radial outer portion of the lower surface of the top wall of the radome along a circumferential direction, and the projections are disposed at a radial outer portion of the antenna bracket along a circumferential direction.

In some embodiments, the projections are formed integrally with the antenna bracket.

In some embodiments, the projections are formed separately from the antenna bracket and fixed to the antenna bracket.

In some embodiments, the projections and the blind holes are circular, elliptical, or polygonal.

In some embodiments, the projections are pins.

In some embodiments, the antenna bracket is provided with a flange projecting downwardly or projecting upwardly around a circumference of the antenna bracket, wherein the flange has an outer cross-sectional dimension that is slightly smaller than an inner cross-sectional dimension of the side wall of the radome, and the floating connection portion is configured as a cooperation between the flange of the antenna bracket and the side wall of the radome.

In some embodiments, the flange is continuous or discontinuous around a circumference of the antenna bracket.

In some embodiments, the fixed connection portion is configured to fix positions of the radome on the antenna core in both the horizontal and the vertical directions.

In some embodiments, the fixed connection portion fixes positions of the radome on the antenna core in the horizontal direction and the vertical direction, by screws passing through screw holes in the antenna base and corresponding screw holes in the side wall of the radome.

In some embodiments, a plurality of screw connections are provided around circumferences of the radome and the antenna base.

In some embodiments, each of the screw connections includes one screw, or two or more screws.

As a second aspect, embodiments of the invention are directed to a base station antenna comprising an antenna core and a radome sleeved over the antenna core, wherein the antenna core and the radome are connected together by a fixed connection portion located near a bottom end of the radome and a floating connection portion located near a top end of the radome, wherein the fixed connection portion is configured to fix positions of the radome on the antenna core in both horizontal and vertical directions, and the floating connection portion is configured to fix a position of the radome on the antenna core in a horizontal direction and allow the radome to float relative to the antenna core in a vertical direction.

In some embodiments, the floating connection portion is configured as a hole and projection engagement between the antenna bracket and the radome.

In some embodiments, the antenna core is provided with holes, and the radome is provided with projections projecting downwardly, wherein the holes and the projections are in corresponding positions along a circumferential direction and a radial direction of the base station antenna.

In some embodiments, the projections are formed integrally with the antenna bracket.

In some embodiments, the projections are formed separately from the antenna bracket and fixed to the antenna bracket.

In some embodiments, the antenna bracket is provided with projections projecting upwardly, and the radome is provided with blind holes, wherein the blind holes and the projections are in corresponding positions along a circumferential direction and a radial direction of the base station antenna.

In some embodiments, the projections are formed integrally with the antenna bracket.

In some embodiments, the projections are formed separately from the antenna bracket and fixed to the antenna bracket.

In some embodiments, the antenna bracket is provided with a flange projecting downwardly around a circumference of the antenna bracket, wherein the flange has an outer cross-sectional dimension that is slightly smaller than an inner cross-sectional dimension of the radome, and the floating connection portion is configured as a cooperation between the flange of the antenna bracket and an interior of the radome.

In some embodiments, the fixed connection portion fixes positions of the radome on the antenna core in the horizontal direction and the vertical direction, by screws passing through the antenna core and the radome.

Other features and advantages of the subject art of the present disclosure will be formulated in the following descriptions, and will be partially obvious from said descriptions, or may be learned by practicing the subject art of the present disclosure. Advantages of the subject art of the present disclosure will be realized and attained by the structure particularly set forth in the written description as well as its claims and drawings.

It should be understood that, the aforementioned general descriptions and the following detailed descriptions are all embodimental and descriptive, and intended to provide further illustrations of the subject art of the present disclosure for which protection is sought.

BRIEF DESCRIPTION OF THE DRAWINGS

After reading the embodiments hereinafter in combination with the drawings, a plurality of aspects of the present disclosure will be better understood. In the drawings.

DETAILED DESCRIPTION OF THE EMBODIMENTS

Figure 1:
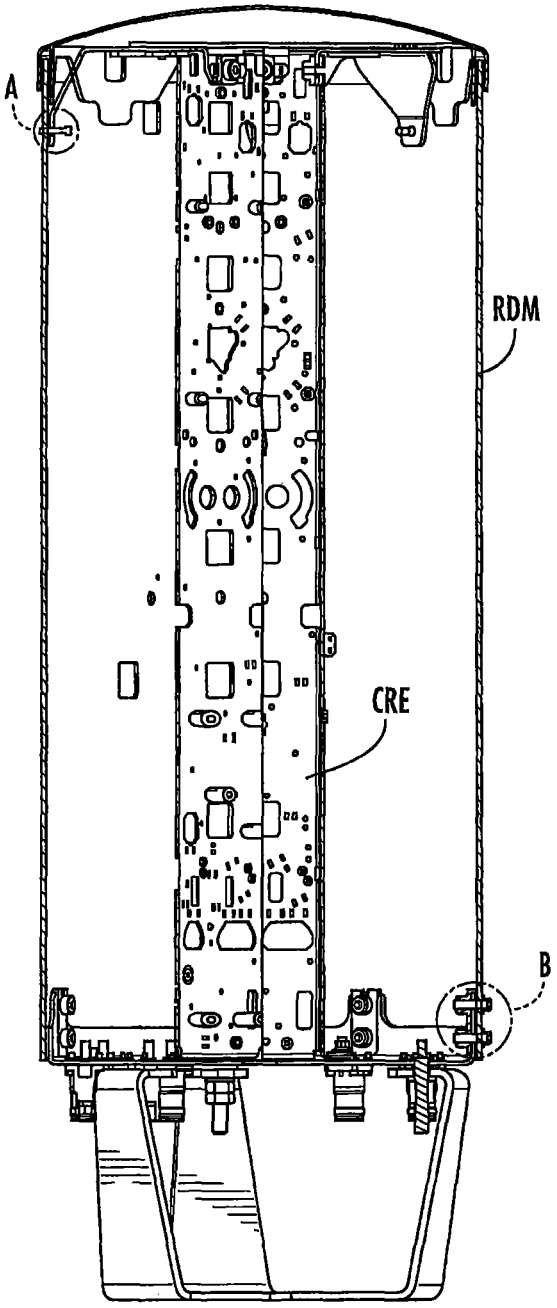
FIG. 1 (Prior Art)
FIG. 1 shows a cross-sectional view of a prior art base station antenna.
Figure 2A:
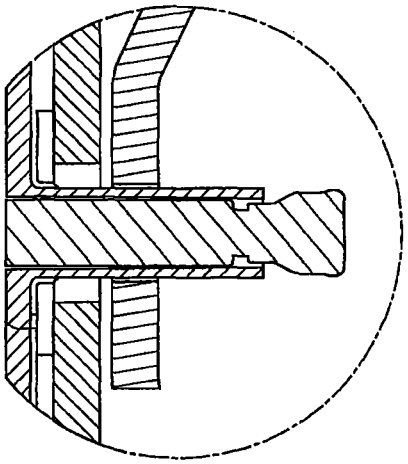
FIG. 2A (Prior Art)
FIGS. 2A and 2B are enlarged views of the upper and lower connection portions of the base station antenna of FIG. 1.
Figure 2B:
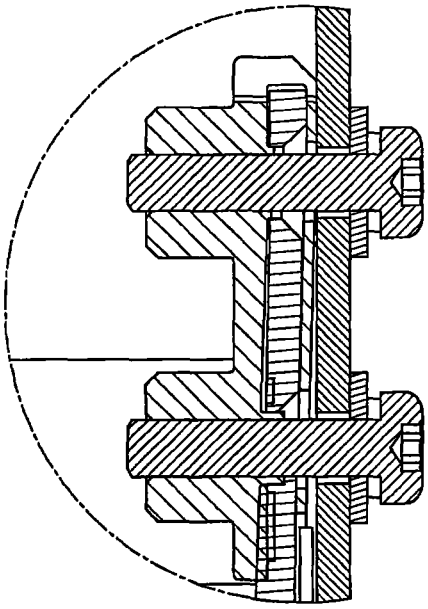
FIG. 2B (Prior Art)

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, in all the drawings, the same reference signs present the same elements. In the drawings, for the sake of clarity, the sizes of certain features may be deformed.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "containing" and "including" used in the specification indicate the presence of the claimed features, but do not repel the presence of one or more other features. The wording "and/or" as used in the specification includes any and all combinations of one or more of the relevant items listed. The phases "between X and Y" and "between about X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element. By contrast, where one element is referred to as being "directly" on another element, "directly attached to" another element, "directly connected to" another element, "directly coupled to" another element, or "in direct contact with" another element, there will not be present with an intermediate element. In the specification, where one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwisely oriented (rotated 90 degrees or at other orientations). At this time, the relative spatial relations will be explained correspondingly.

Figure 3:
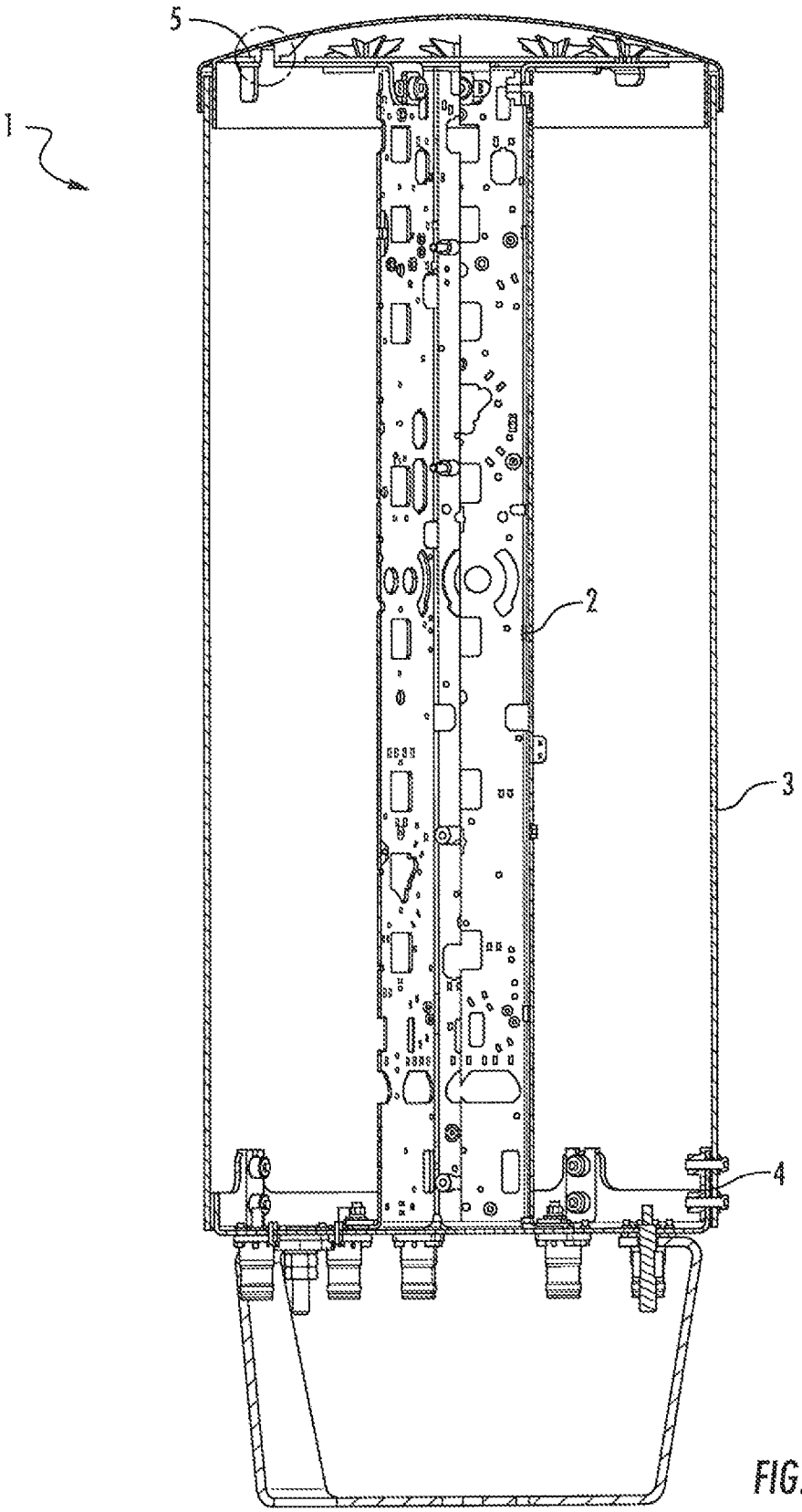
FIG. 3 shows a cross-sectional view of a base station antenna according to an embodiment of the present disclosure.

FIG. 3 shows a cross-sectional view of a base station antenna 1 according to an embodiment of the present disclosure. As shown in the drawing, the base station antenna 1 includes an elongated antenna core 2 and a radome 3 sleeved over the antenna core 2. The antenna core 2 implements the core functions of the base station antenna, that is, transmitting signals and receiving signals, while the radome 3 protects the antenna core 2 from damage due to the natural or external environment.

Figure 4:
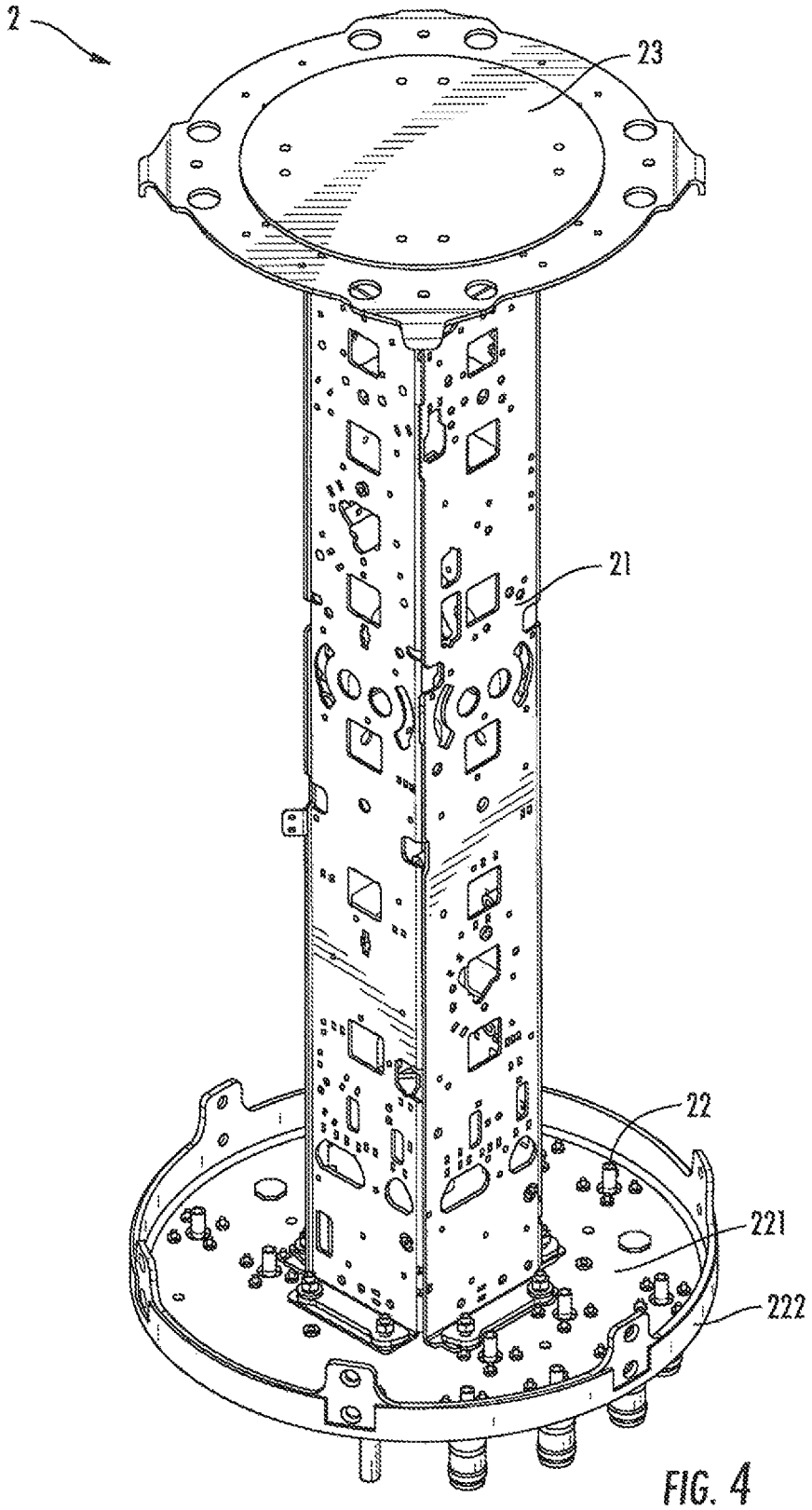
FIG. 4 shows a perspective view of an antenna core of a base station antenna according to an embodiment of the present disclosure.

FIG. 4 shows a perspective view of an antenna core 2 of a base station antenna 1 according to an embodiment of the present disclosure. As shown in the drawing, the antenna core 2 includes an antenna body 21, an antenna base 22 at the bottom of the antenna body 21 and an antenna bracket 23 at the top of the antenna body 21. The antenna base 22 is fixed to the bottom of the antenna body 21 and serves to support the antenna body 21. The antenna base 22 protrudes radially outward from the bottom of the antenna body 21, and includes a bottom wall 221 and a side wall 222 that protrudes vertically upward around a circumference of the bottom wall 221. The antenna bracket 23 is fixed to the top of the antenna body 21. The antenna bracket 23 is disk-shaped and protrudes radially outward from the top of the antenna body 22. Both the antenna base 22 and the antenna bracket 23 have a substantially circular cross-section.

Figure 5:
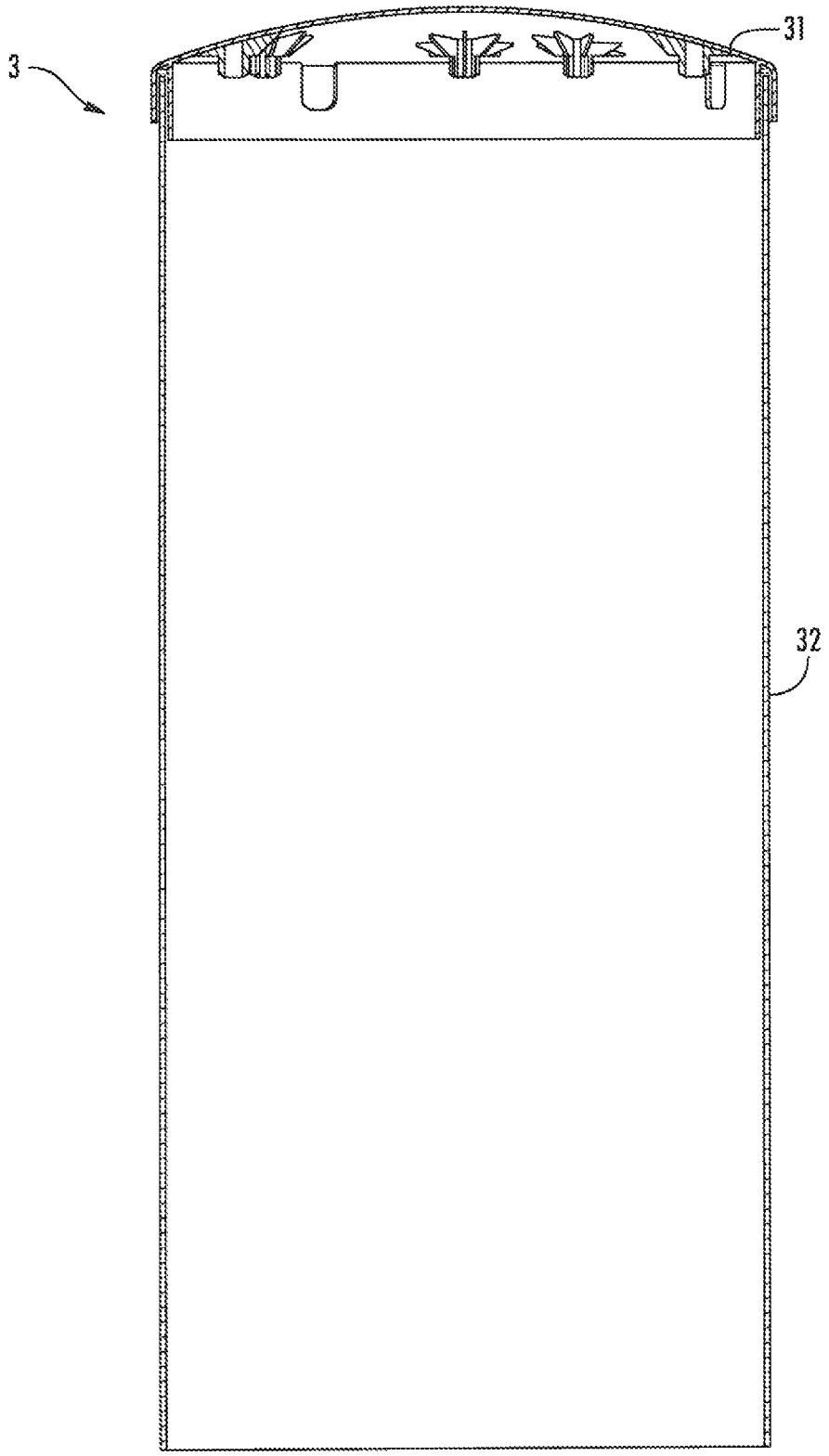
FIG. 5 shows a cross-sectional view of a radome of a base station antenna according to an embodiment of the present disclosure.

FIG. 5 shows a cross-sectional view of a radome 3 of a base station antenna 1 according to an embodiment of the present disclosure. As shown in the drawing, the radome 3 has a substantially cylindrical shape with one end closed and one end open. The radome 3 includes a top wall 31 and a side wall 32. The side wall 32 surrounds the top wall 31 and extends downward perpendicular to the top wall 31.

Returning to FIG. 3, the antenna core 2 and the radome 3 are connected together by a fixed connection portion 4 and a floating connection portion 5 which are disposed at different heights. The fixed connection portion 4 fixes positions of the radome 3 relative to the antenna core 2 in both the horizontal and vertical directions. The floating connection portion 5 fixes the position of the radome 3 on the antenna core 2 in the horizontal direction, but does not constrain the position of the radome 3 on the antenna core 2 in the vertical direction. The fixed connection portion 4 is located near a bottom end of the radome 3, while the floating connection portion 5 is located near a top end of the radome 3.

Figure 6:
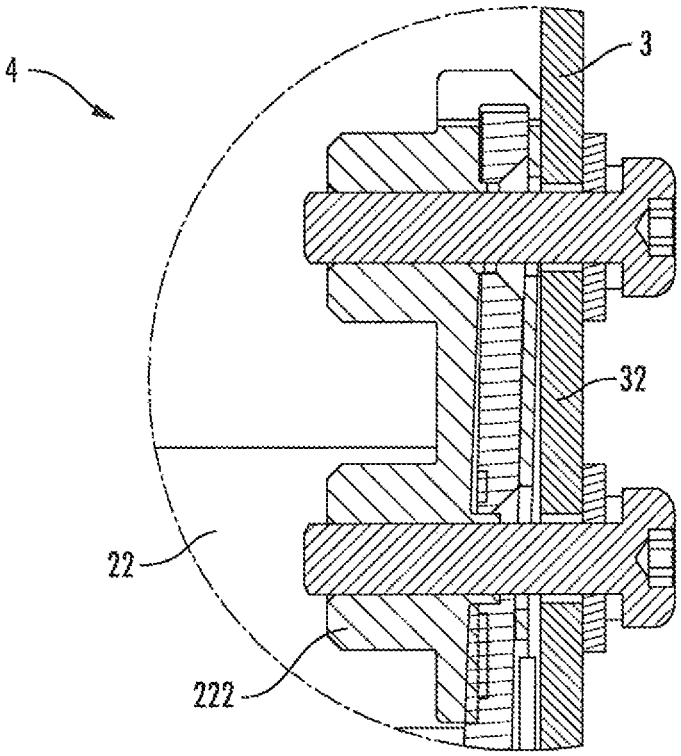
FIG. 6 shows an enlarged cross-sectional view of a fixed connection portion of a base station antenna according to an embodiment of the present disclosure.

In some embodiments, as shown in FIG. 6, the fixed connection portion 4 fixes positions of the radome 3 on the antenna core 2 in the horizontal direction and the vertical direction, by screws passing through screw holes in the side wall 222 of the antenna base 22 and corresponding screw holes in the side wall 32 of the radome 3. In some embodiments, a plurality of screw connections may be uniformly provided around the circumferences of the radome 3 and the antenna base 22. Each of the screw connections may include one screw, or two or more screws in any suitable arrangement.

In some embodiments, the floating connection portion 5 fixes the position of the radome 3 on the antenna core 2 in a horizontal direction and allows the radome 3 to float relative to the antenna core 2 in a vertical direction by engagement of an aperture (e.g., a hole, slot, slit, recess, etc.) and a projection (e.g., a pin, post, nub, etc.) between the antenna bracket 23 of the antenna core 2 and the top wall 31 of the radome 3.

Figure 7:
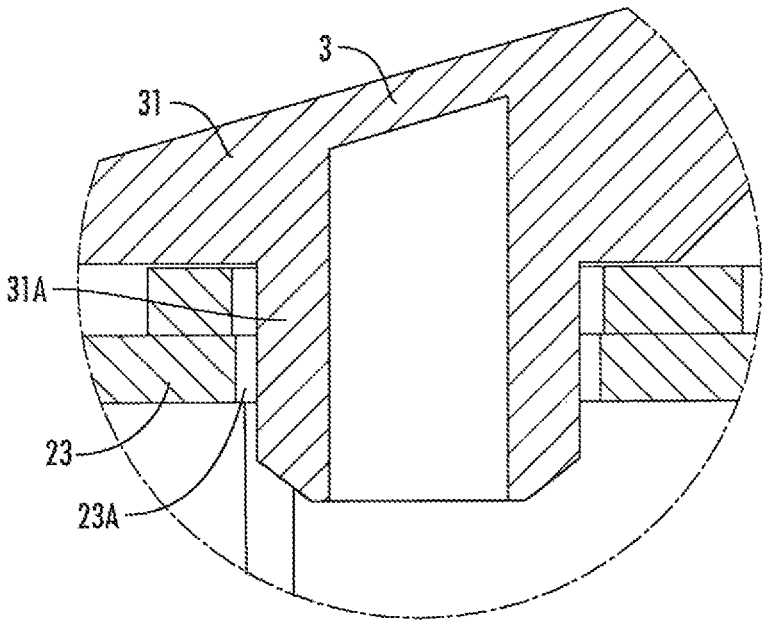
FIG. 7 shows an example of an enlarged cross-sectional view of a floating connection portion of a base station antenna according to an embodiment of the present disclosure.

FIG. 7 shows one embodiment of a hole and projection engagement between the antenna bracket 23 and the radome 3. As shown in the drawing, the antenna bracket 23 is provided with holes 23A, while the lower surface of the top wall 31 of the radome 3 is provided with projections 31A which protrude vertically downward. The holes 23A and the projections 31A are in corresponding positions along a circumferential direction and a radial direction of the base station antenna 1. In some embodiments, the holes 23A are uniformly disposed at a radial outer portion of the antenna bracket 23 along a circumferential direction, and correspondingly, the projections 31A are uniformly disposed at a radial outer portion of the lower surface of the top wall 31 of the radome 3 along a circumferential direction. The projections 31A and the holes 23A may be circular, elliptical, triangular, square, in other polygonal shapes, or in any other suitable shape, as long as the projection 31A can be inserted into the hole 23A without a major offset therebetween in the horizontal direction. The projections 31A may be formed integrally with the radome 3 (for example, formed by molding), or may be formed separately and fixed to the radome 3 in any known connection manner (e.g., welding, adhering, etc.). In some embodiments, the projection 31A may be a pin.

When the radome 3 is sleeved over the antenna core 2, the projections 31A of the radome 3 are easily fit to the holes 23A of the antenna bracket 23 through rotation of the radome 3, so as to accomplish the installation of the floating connection portion 5. Thereafter, the screws are passed through the screw holes in the antenna base 22 and the corresponding screw holes in the radome 3 and tightened at the fixed connection portion 4, so as to accomplish the installation of the fixed connection portion 4. Thereby, the connection of the radome 3 to the antenna core 2 is achieved.

Figure 8:
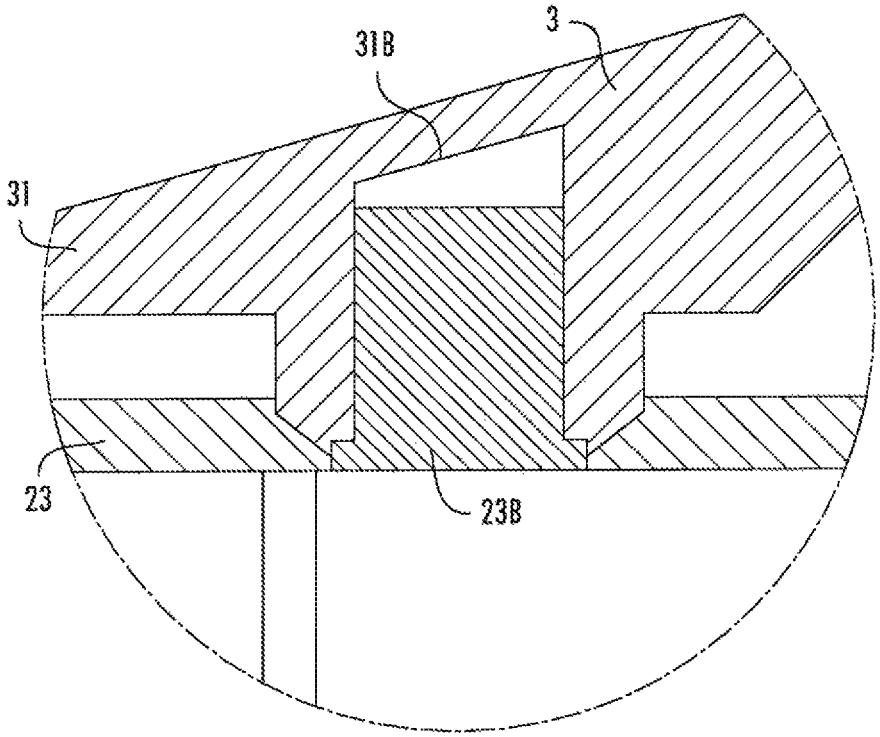
FIG. 8 shows another example of an enlarged cross-sectional view of a floating connection portion of a base station antenna according to an embodiment of the present disclosure.

FIG. 8 shows another embodiment of a hole and projection engagement between the antenna bracket 23 and the radome 3. As shown in the drawing, the antenna bracket 23 is provided with projections 23B which protrude vertically upward, and the lower surface of the top wall 31 of the radome 3 is provided with blind holes 31B which are open downward. The projections 23B of the antenna bracket 23 and the blind holes 31B of the radome 3 are in corresponding positions along a circumferential direction and a radial direction of the base station antenna 1. In some embodiments, the projections 23B are uniformly disposed at a radial outer portion of the antenna bracket 23 along a circumferential direction, and correspondingly, the blind holes 31B are uniformly disposed at a radial outer portion of the lower surface of the top wall 31 of the radome 3 along a circumferential direction. The projections 23B and the blind holes 31B may be circular, elliptical, triangular, square, in other polygonal shapes, or in any other suitable shape, as long as the projections 23B can be inserted into the blind holes 31B without a major offset therebetween in the horizontal direction. The projections 23B may be formed integrally with the antenna bracket 23, or formed separately and fixed to the antenna bracket 23 in any known connection manner (e.g., welding, adhering, etc.). In some embodiments, the projection 23B may be a pin.

When the radome 3 is sleeved over the antenna core 2, the blind holes 31B of the radome 3 are easily fit to the projections 23B of the antenna bracket 23 by rotation of the radome 3, to achieve installation of the floating connection portion 5. Thereafter, the screws are passed through the screw holes in the antenna base 22 and the corresponding screw holes in the radome 3 and tightened at the fixed connection portion 4, to achieve installation of the fixed connection portion 4. Thereby, the connection of the radome 3 to the antenna core 2 is achieved.

Figure 9:
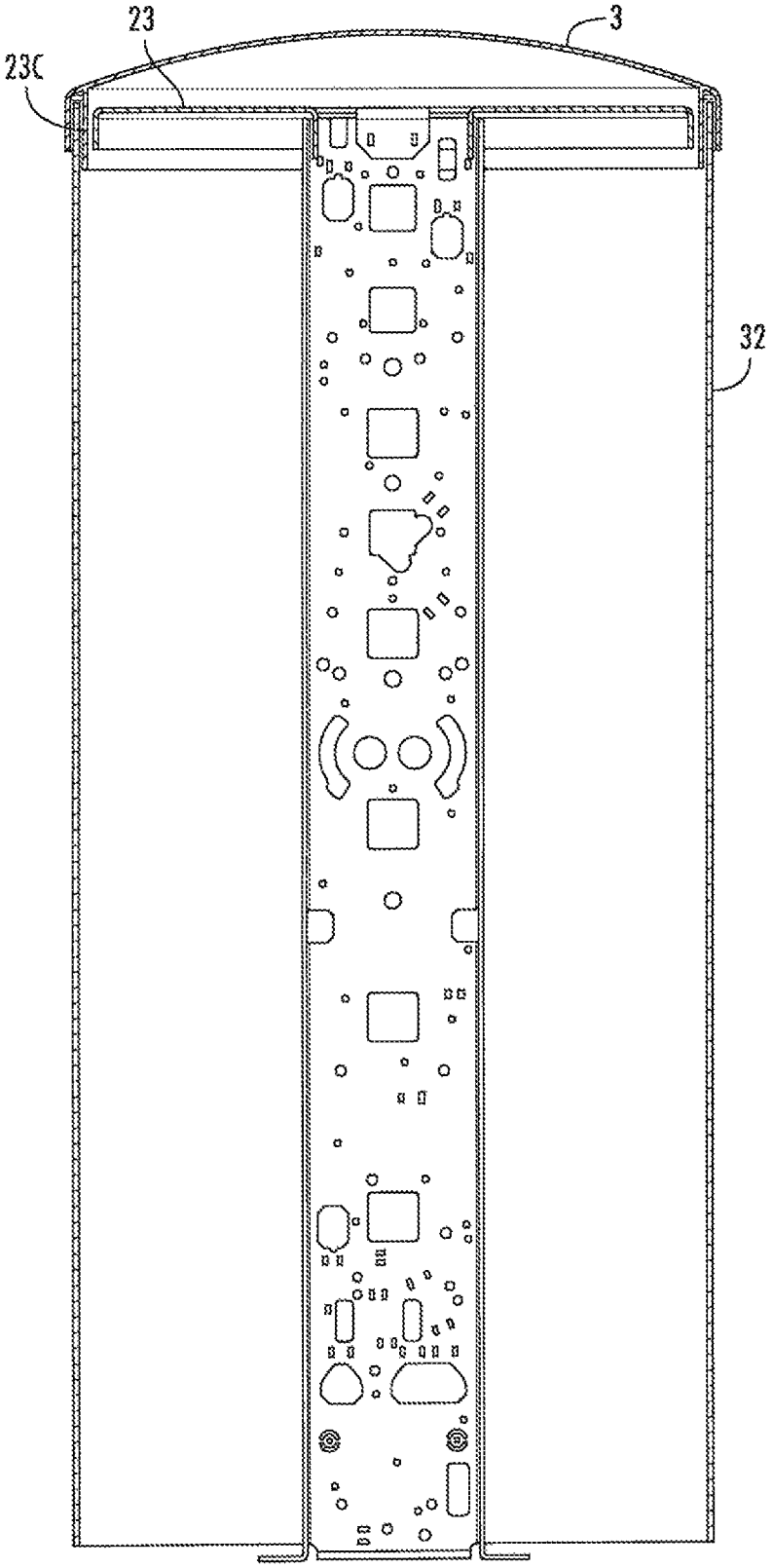
FIG. 9 shows still another example of a floating connection portion of a base station antenna according to an embodiment of the present disclosure.

In some embodiments, as shown in FIG. 9, the antenna bracket 23 is provided with a flange 23C that protrudes vertically downward or upward around a circumference of the antenna bracket. The flange 23C has an outer cross-sectional dimension that is slightly smaller than an inner cross-sectional dimension of the side wall 32 of the radome 3, so that the flange 23C can float vertically up and down along the side wall 32 of the radome 3. Therefore, the floating connection portion 5 fixes the position of the radome 3 on the antenna core 2 in a horizontal direction and allows the radome 3 to float relative to the antenna core 2 in a vertical direction by cooperation between the flange 23C of the antenna bracket 23 of the antenna core 2 and the side wall 32 at the top of the radome 3. The flange 23C may be continuous or discontinuous around the circumference of the antenna bracket.

In the base station antenna according to the present disclosure, the fixed connection portion and the floating connection portion are disposed along different heights. When there is a temperature change in ambient environment, the radome can float relative to the antenna core along the vertical direction, which solves the problem of a tensile force between the antenna core and the radome resulting from the temperature change, thereby improving the performance parameters such as PIM of the base station antenna.

Although the exemplary embodiments of the present disclosure have been described, a person skilled in the art should understand that, he or she can make multiple changes and modifications to the exemplary embodiments of the present disclosure without substantively departing from the spirit and scope of the present disclosure. Accordingly, all the changes and modifications are encompassed within the protection scope of the present disclosure as defined by the claims. The present disclosure is defined by the appended claims, and the equivalents of these claims are also contained therein.

What is claimed is:

1. A base station antenna comprising:

an antenna core comprising an antenna body, an antenna base fixed to a bottom end of the antenna body, and an antenna bracket fixed to an opposite top end of the antenna body; and a radome sleeved over the antenna core, wherein the radome includes a top wall and a side wall that protrudes downward from the top wall, wherein the antenna base and the radome are connected together by a fixed connection portion located near a bottom end of the radome, and wherein the antenna bracket and the radome are connected together by a floating connection portion located near a top end of the radome, wherein the floating connection portion fixes a position of the radome on the antenna core in a horizontal direction and allows the radome to float relative to the antenna core in a vertical direction by cooperating the antenna bracket with the top wall of the radome or the side wall at the top of the radome, wherein the floating connection portion is configured to permit unrestricted floating without a latch of the antenna bracket and radome in the vertical direction.

2. The base station antenna according to claim 1, wherein the floating connection portion is configured as a hole and projection engagement between the antenna bracket and the top wall of the radome.

3. The base station antenna according to claim 2, wherein the antenna bracket is provided with holes, and a lower surface of the top wall of the radome is provided with projections projecting downwardly, wherein the holes and the projections are in corresponding positions along a circumferential direction and a radial direction of the base station antenna.

4. The base station antenna according to claim 3, wherein the holes are disposed at a radial outer portion of the antenna bracket along a circumferential direction, and the projections are disposed at a radial outer portion of the lower surface of the top wall of the radome along a circumferential direction.

5. The base station antenna according to claim 3, wherein the projections are formed integrally with the radome.

6. The base station antenna according to claim 3, wherein the projections are formed separately from the radome and fixed to the radome.

7. The base station antenna according to claim 3, wherein the projections and the holes are circular, elliptical, or polygonal.

8. The base station antenna according to claim 2, wherein the antenna bracket is provided with projections projecting upwardly, and the lower surface of the top wall of the radome is provided with blind holes, wherein the blind holes and the projections are in corresponding positions along a circumferential direction and a radial direction of the base station antenna.

9. The base station antenna according to claim 8, wherein the blind holes are disposed at a radial outer portion of the lower surface of the top wall of the radome along a circumferential direction, and the projections are disposed at a radial outer portion of the antenna bracket along a circumferential direction.

10. The base station antenna according to claim 8, wherein the projections are formed integrally with the antenna bracket.

11. The base station antenna according to claim 8, wherein the projections are formed separately from the antenna bracket and fixed to the antenna bracket.

12. The base station antenna according to claim 8, wherein the projections and the blind holes are circular, elliptical, or polygonal.

13. The base station antenna according to claim 2, wherein the projections are pins.

14. The base station antenna according to claim 1, wherein the antenna bracket is provided with a flange projecting downwardly or projecting upwardly around a circumference of the antenna bracket, wherein the flange has an outer cross-sectional dimension that is slightly smaller than an inner cross-sectional dimension of the side wall of the radome, and the floating connection portion is configured as a cooperation between the flange of the antenna bracket and the side wall of the radome.

15. The base station antenna according to claim 14, wherein the flange is continuous or discontinuous around a circumference of the antenna bracket.

16. The base station antenna according to claim 1, wherein the fixed connection portion is configured to fix positions of the radome on the antenna core in both the horizontal and the vertical directions.

17. The base station antenna according to claim 16, wherein the fixed connection portion fixes positions of the radome on the antenna core in the horizontal direction and the vertical direction, by screws passing through screw holes in the antenna base and corresponding screw holes in the side wall of the radome.

18. The base station antenna according to claim 17, wherein a plurality of screw connections are provided around circumferences of the radome and the antenna base.

19. The base station antenna of claim 18, wherein each of the screw connections includes one screw, or two or more screws.

20. A base station antenna, comprising:

an antenna core comprising opposite top and bottom end portions; and a radome sleeved over the antenna core, wherein the antenna core bottom end portion and the radome are connected together by a fixed connection portion located near a bottom end of the radome, and wherein the antenna core top end portion and the radome are connected together by a floating connection portion located near a top end of the radome, wherein the fixed connection portion is configured to fix positions of the radome on the antenna core in both horizontal and vertical directions, and the floating connection portion is configured to fix a position of the radome on the antenna core in a horizontal direction and allow the radome to float relative to the antenna core in a vertical direction, wherein the floating connection portion is configured to permit unrestricted floating without a latch of the antenna core and radome in the vertical direction.

* * * * *